US011703898B2

(12) United States Patent
Georgievski et al.

(10) Patent No.: US 11,703,898 B2
(45) Date of Patent: Jul. 18, 2023

(54) LOW DROPOUT (LDO) VOLTAGE REGULATOR

(71) Applicant: Allegro MicroSystems, LLC, Manchester, NH (US)

(72) Inventors: Gorjan Georgievski, Milan (IT); Giorgio Oddone, Aosta (IT); Michele Suraci, Turate (IT)

(73) Assignee: Allegro MicroSystems, LLC, Manchester, NH (US)

( * ) Notice: Subject to any disclaimer, the term of this patent is extended or adjusted under 35 U.S.C. 154(b) by 229 days.

(21) Appl. No.: 17/371,281

(22) Filed: Jul. 9, 2021

(65) Prior Publication Data

US 2023/0009164 A1 Jan. 12, 2023

(51) Int. Cl.
*G05F 1/573* (2006.01)
*G05F 1/575* (2006.01)

(52) U.S. Cl.
CPC ..... *G05F 1/573* (2013.01); *G05F 1/575* (2013.01)

(58) Field of Classification Search
CPC ..... G05F 1/573; G05F 1/575
See application file for complete search history.

(56) References Cited

U.S. PATENT DOCUMENTS

| | | | |
|---|---|---|---|
| 5,514,901 | A | 5/1996 | Peppiette et al. |
| 7,851,940 | B2 | 12/2010 | Mahin et al. |
| 9,155,156 | B2 | 10/2015 | Szczeszynski |
| 9,285,812 | B2 | 3/2016 | Wibben et al. |
| 9,520,871 | B2 | 12/2016 | Eagen et al. |
| 9,614,428 | B2 | 4/2017 | Garvey et al. |
| 9,774,257 | B2 | 9/2017 | Wibben et al. |
| 10,209,279 | B2 | 2/2019 | Tran et al. |
| 10,367,500 | B2 | 7/2019 | Wibben |
| 10,527,703 | B2 | 1/2020 | Monreal et al. |

(Continued)

FOREIGN PATENT DOCUMENTS

| | | | | |
|---|---|---|---|---|
| CN | 105229551 | A * | 1/2016 | ..... G05F 1/5735 |
| EP | 3904999 | A1 * | 11/2021 | ..... G05F 1/462 |
| EP | 3933543 | A1 * | 1/2022 | |

OTHER PUBLICATIONS

English translation of "105229551" Torres, H Electronic current limiting device ,Jan. 6, 2016 (Year: 2016).*

(Continued)

*Primary Examiner* — Sisay G Tiku
(74) *Attorney, Agent, or Firm* — Daly, Crowley, Mofford & Durkee, LLP

(57) ABSTRACT

A low dropout (LDO) voltage regulator includes a first LDO stage that receives a first supply voltage and is active during a first time interval and a second LDO stage that receives a second supply voltage and is active during a second time interval. An operational amplifier receives a feedback voltage based on the LDO output voltage and provides an amplified feedback signal to the first and second LDO stages. A compensation capacitor is selectively coupled between the operational amplifier and either the first or the second LDO stage. A current limit circuit includes a sense FET coupled to the LDO pass FET, a drain voltage replication circuit coupled between the pass FET and sense FET to provide a sense current is indicative of load current when the pass FET is in a linear region, and a current comparator to compare the sense current to a predetermined current level.

21 Claims, 4 Drawing Sheets

(56) References Cited

U.S. PATENT DOCUMENTS

| | | | | |
|---|---|---|---|---|
| 10,831,221 | B1 * | 11/2020 | Tesch | G05F 1/575 |
| 10,837,987 | B2 | 11/2020 | Tran et al. | |
| 2003/0122595 | A1 * | 7/2003 | Hall | H03K 17/6872 327/112 |
| 2009/0058380 | A1 * | 3/2009 | Lee | H02M 3/156 323/271 |
| 2011/0309808 | A1 * | 12/2011 | Zanchi | G05F 1/575 323/282 |
| 2016/0246318 | A1 * | 8/2016 | Zanchi | G05F 1/575 |
| 2017/0115678 | A1 * | 4/2017 | Qing | G05F 1/575 |
| 2021/0048456 | A1 | 2/2021 | Tran et al. | |
| 2021/0333812 | A1 * | 10/2021 | Liu | G05F 1/563 |
| 2022/0147082 | A1 * | 5/2022 | Melanson | G05F 1/575 |
| 2023/0037837 | A1 * | 2/2023 | Englekirk | G05F 1/565 |

OTHER PUBLICATIONS

Al-Shyoukh et al. "A Transient-Enhanced Low-Quiescent Current Low-Dropout Regulator with Buffer Impedance Attenuation" IEEE Journal of Solid-State Circuits, vol. 42, No. 8, Aug. 2007, 11 pages.

De Lima et al. "A Current Limiter for LDO Regulators with Internal Compensation Ffor Process and Temperature Variations" IEEE, 2008, 4 pages.

* cited by examiner

LOW DROPOUT (LDO) VOLTAGE REGULATOR

CROSS-REFERENCE TO RELATED APPLICATIONS

Not Applicable.

FIELD

This disclosure relates generally to low dropout voltage regulators.

BACKGROUND

As is known, low dropout (LDO) voltage regulators, or simply LDO regulators, are used in a variety of applications to power circuitry in applications in which the input voltage can be close to the output voltage. Generally, LDO regulators are linear regulators that include a pass element and an operational amplifier to regulate conduction of the pass element with a low dropout voltage. Dropout voltage refers to the difference between the output voltage and the lowest specified level of input voltage at the specified load current that is required to maintain regulation of the output voltage.

LDO regulators are often used in applications in which power dissipation and quiescent current are important characteristics. Quiescent current, Iq, refers to the current drawn by the regulator at no load or light load conditions. LDO regulators typically include current limit circuitry in order to protect the regulator itself and the load.

Because LDO regulators often supply a wide range loads, ensuring stable operation over the load range can require the use of a relatively large output compensation capacitor. The large output capacitor increases the cost of using the LDO regulator and can also require higher quiescent current consumption in order to set the gain of the operational amplifier to a value that minimizes the effect of the parasitic pole of the pass element.

SUMMARY

Described herein are circuits and methods for providing an LDO voltage regulator with a relatively low output capacitance requirement. The low output capacitance permits the LDO voltage regulator to operate with relatively low quiescent current, thereby enabling the LDO voltage regulator to remain on when the application system (e.g., DC-DC converter) is operated in a low power mode. The LDO regulator includes an operational amplifier and an internal compensation capacitor shared by multiple LDO stages, thereby reducing area requirements. The described LDO voltage regulator implements a compensation strategy that adds a pole and a zero to ensure stability over the entire range of operation.

According to the disclosure, a low dropout voltage regulator includes a first LDO stage coupled to receive a first supply voltage and active during a first time interval, the first LDO stage having an input coupled to receive an amplified feedback signal and an output at which an LDO output voltage is provided and a second LDO stage coupled to receive a second supply voltage and active during a second time interval that does not overlap with the first time interval, the second LDO stage having an input coupled to receive the amplified feedback signal and an output at which the LDO output voltage is provided. An operational amplifier has a first input coupled to receive a feedback voltage based on the LDO output voltage, a second input coupled to receive a reference voltage, and an output at which the amplified feedback signal is provided. A compensation capacitor is selectively coupled between the operational amplifier and either the first LDO stage or second LDO stage.

Features may include one or more of the following individually or in combination with other features. The compensation capacitor can be coupled to the first LDO stage during the first time interval and can be coupled to the second LDO stage during the second time interval. Each of the first LDO stage and the second LDO stage can include a buffer amplifier and a pass element, wherein the buffer amplifier has an input coupled to receive the amplified feedback signal and an output coupled to a control terminal of the pass element. During the first time interval, the compensation capacitor can be coupled between an output of the buffer amplifier of the first LDO stage and the operational amplifier and, during the second time interval, the compensation capacitor can be coupled between an output of the buffer amplifier of the second LDO stage and operational amplifier. The LDO regulator can include a first current limit circuit configured to sense a load current through the pass element of the first LDO stage and couple the control terminal of the pass element of the first LDO stage to the first supply voltage if the sensed load current is greater than a predetermined current level. The pass element of the first LDO stage can be a pass FET having a drain terminal and a source terminal and the control terminal of the pass element can be a gate terminal and the first current limit circuit can include a sense FET, a drain voltage replication circuit, and a current comparator. The sense FET can have a gate terminal coupled to the gate terminal of the pass FET, a source terminal coupled to the first supply voltage and a drain terminal and be configured to generate the sensed load current. The drain voltage replication circuit can be coupled between the drain terminal of the pass FET and the drain terminal of the sense FET and configured to replicate the voltage on the drain terminal of the pass FET so that the sensed load current is indicative of the load current through the pass FET when the pass FET is in a linear region and the current comparator can be configured to compare the sensed load current to the predetermined current level. In embodiments, the LDO regulator can include a second current limit circuit configured to sense a load current through the pass element of the second LDO stage and couple the control terminal of the pass element of the second LDO stage to the second supply voltage if the sensed load current is greater than the predetermined level. The pass element of the second LDO stage can be a pass FET having a drain terminal and a source terminal and wherein the control terminal of the pass element can be a gate terminal and the second current limit circuit can include a sense FET, a voltage replication circuit, and a current comparator. The sense FET can have a gate terminal coupled to the gate terminal of the pass FET, a source terminal coupled to the second supply voltage and a drain terminal and can be configured to generate the sensed load current. The drain voltage replication circuit can be coupled between the drain terminal of the pass FET and the drain terminal of the sense FET and configured to replicate the voltage on the drain terminal of the pass FET so that the sensed load current is indicative of the load current through the pass FET when the pass FET is in a linear region. The current comparator can be configured to compare the sensed load current to the predetermined current level. The first time interval can occur when either the LDO output voltage is less than a predetermined LDO output voltage level or the second supply voltage is less than a predetermined second supply voltage level and the second time interval can occur when both the LDO output voltage is greater than the predetermined LDO output voltage level and the second supply voltage is greater than the predetermined second supply voltage level.

Also described is a converter including a power stage responsive to a supply input voltage and configured to generate a regulated output voltage, wherein the power stage is coupled to receive an LDO output voltage and a low dropout (LDO) voltage regulator responsive to the supply input voltage during a first time interval and responsive to the regulated output voltage during a second time interval that does not overlap with the first time interval, wherein the LDO voltage regulator is configured to generate the LDO output voltage. The LDO voltage regulator can include a first LDO stage coupled to receive the supply input voltage and active during the first time interval, the first LDO stage having an input coupled to receive an amplified feedback signal and an output at which the LDO output voltage is provided and a second LDO stage coupled to receive the regulated output voltage and active during the second time interval, the second LDO stage having an input coupled to receive the amplified feedback signal and an output at which the LDO output voltage is provided. The LDO voltage regulator can further include an operational amplifier having a first input coupled to receive a feedback voltage based on the LDO output voltage, a second input coupled to receive a reference voltage and an output at which the amplified feedback signal is provided and a compensation capacitor selectively coupled between the operational amplifier and either the first LDO stage or the second LDO stage.

Features may include one or more of the following individually or in combination with other features. The converter can include one or more auxiliary circuits coupled to receive the LDO output voltage. The compensation capacitor can be coupled to the first LDO stage during the first time interval and can be coupled to the second LDO stage during the second time interval. The first LDO stage can include a first buffer amplifier and a first pass FET, wherein the first buffer amplifier has an input coupled to receive the amplified feedback signal and an output coupled to a gate terminal of the first pass FET and the second LDO stage can include a second buffer amplifier and a second pass FET, wherein the second buffer amplifier has an input coupled to receive the amplified feedback signal and an output coupled to a gate terminal of the second pass FET. During the first time interval, the compensation capacitor can be coupled between an output of the buffer amplifier of the first LDO stage and the operational amplifier and, during the second time interval, the compensation capacitor can be coupled between an output of the buffer amplifier of the second LDO stage and operational amplifier. The converter can further include one or both of: (1) a first current limit circuit configured to sense a load current through the first pass FET and couple the gate terminal of the first pass FET to the supply input voltage if the sense current is greater than a predetermined current level; and (2) a second current limit circuit configured to sense the load current through the second pass FET and couple the gate terminal of the second pass FET to the regulated output voltage if the sense current is greater than the predetermined current level. The first current limit circuit can include a first sense FET having a gate terminal coupled to the gate terminal of the first pass FET, a source terminal coupled to the supply input voltage and a drain terminal and configured to generate a sense current, a drain voltage replication circuit coupled between the drain terminal of the first pass FET and the drain terminal of the first sense FET and configured to replicate the voltage on the drain terminal of the first pass FET so that the sense current is indicative of the load current through the first pass FET when the first pass FET is in a linear region, and a current comparator configured to compare the sense current to the predetermined current level. The second current limit circuit can include a second sense FET having a gate terminal coupled to the gate terminal of the second pass FET, a source terminal coupled to the regulated output voltage and a drain terminal and configured to generate a sense current, a drain voltage replication circuit coupled between the drain terminal of the second pass FET and the drain terminal of the second sense FET and configured to replicate the voltage on the drain terminal of the second pass FET so that the sense current is indicative of the load current through the second pass FET when the second pass FET is in a linear region, and a current comparator configured to compare the sense current to the predetermined current level.

Also described is a current limit circuit for a low dropout (LDO) voltage regulator including a pass FET having a drain terminal coupled to an input voltage, a gate terminal, and a source terminal at which a load current is provided. The current limit circuit can include a sense FET having a gate terminal coupled to the gate terminal of the pass FET, a source terminal coupled to a supply voltage and a drain terminal and configured to generate a sense current, a drain voltage replication circuit coupled between the drain terminal of the pass FET and the drain terminal of the sense FET and configured to replicate the voltage on the drain terminal of the pass FET so that the sense current is indicative of the load current when the pass FET is in a linear region, and a current comparator configured to compare the sense current to a predetermined current level.

Features may include one or more of the following individually or in combination with other features. The current comparator can be configured couple the gate terminal of the pass FET to the input voltage if the sense current is greater than the predetermined current level. The drain voltage replication circuit can include a current mirror having an input leg in series with the sense FET and a first output leg coupled to the current comparator and a second output leg, and a cascode pair having an input leg coupled to the drain terminal of the pass FET and to the second output leg of the current mirror and an output leg coupled to the input leg of the current mirror and to the drain terminal of the sense FET at which a replicated version of the pass FET drain voltage is provided.

Also described is a method for current limiting in a low dropout voltage regulator including a pass FET having a source terminal coupled to an input voltage, a gate terminal, and a drain terminal at which a load current is provided. The method includes sensing the load current with a sense FET having gate terminal coupled to the gate terminal of the pass FET, a source terminal coupled to the input voltage, and a drain terminal at which a sense current is provided. The method further includes replicating a voltage at the drain terminal of the pass FET with a voltage replication circuit to generate a replicated voltage at the drain terminal of the sense FET and comparing the sense current to a predetermined current level.

Features may include one or more of the following individually or in combination with other features. Replicating a voltage at the drain terminal of the pass FET with a voltage replication circuit can include mirroring the sense current with a current mirror, coupling the current mirror to the drain terminal of the pass FET with a first element of a cascode pair, and coupling the current mirror the drain terminal of the sense FET with a second element of the cascode pair. The method can further include coupling the gate terminal of the pass FET to the input voltage if the sense current exceeds the predetermined current level.

DESCRIPTION OF THE DRAWINGS

The foregoing features may be more fully understood from the following description of the drawings. The drawings aid in explaining and understanding the disclosed technology. Since it is often impractical or impossible to illustrate and describe every possible embodiment, the provided figures depict one or more illustrative embodiments. Accordingly, the figures are not intended to limit the scope of the broad concepts, systems and techniques described herein. Like numbers in the figures denote like elements.

DETAILED DESCRIPTION

Figure 1:
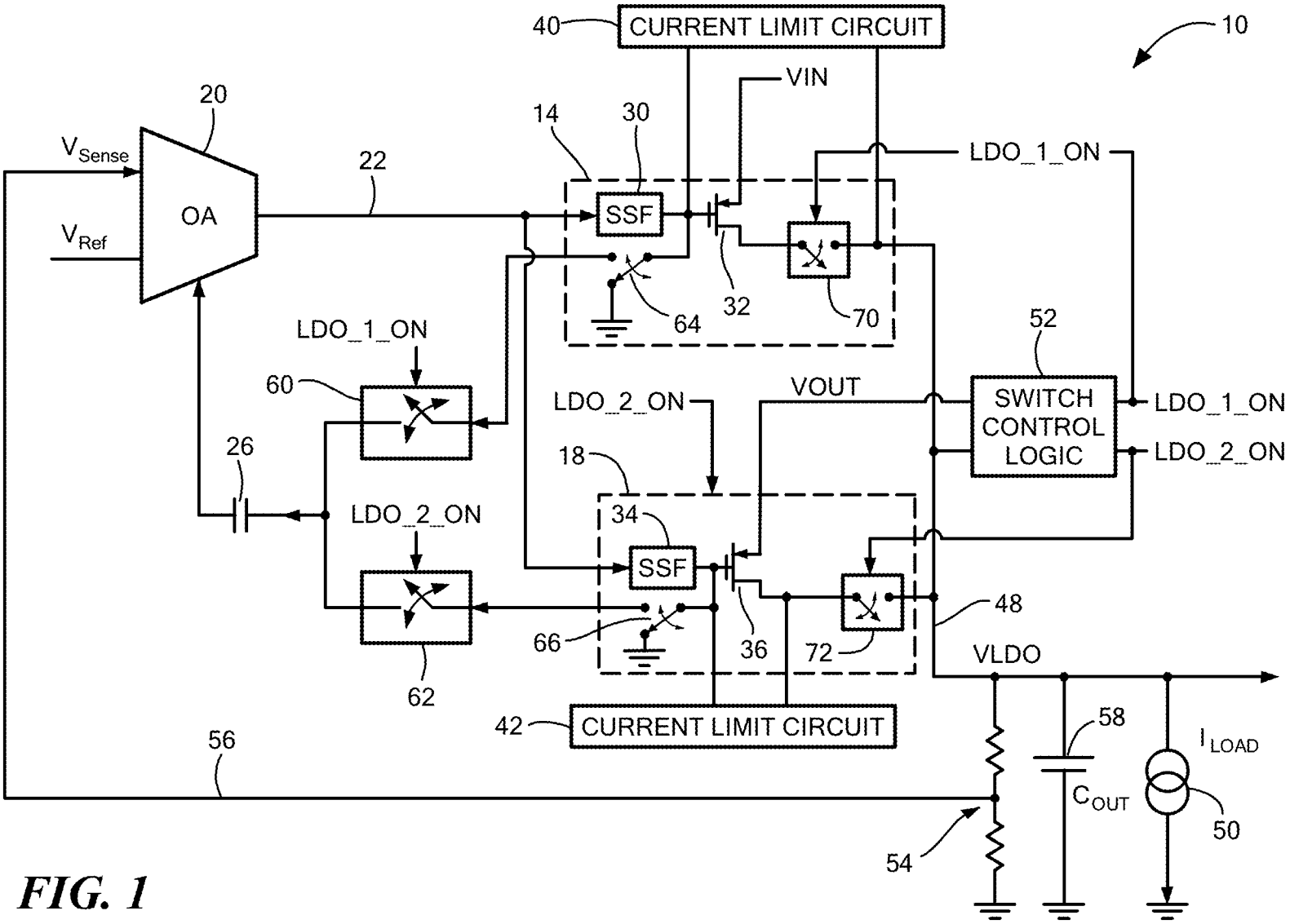
FIG. 1 is an LDO voltage regulator according to the disclosure.

Referring to FIG. 1, an LDO voltage regulator 10 configured to generate a regulated output voltage VLDO for powering a load 50 coupled across an output compensation capacitor 58 includes a first LDO stage 14 and a second LDO stage 18. The first LDO stage 14 is coupled to receive a first supply voltage during a first time interval when the first LDO stage is active and has an input coupled to receive an amplified feedback signal 22 and an output at which the LDO output voltage VLDO is provided and the second LDO stage 18 is coupled to receive a second supply voltage during a second time interval that does not overlap with the first time interval when the second LDO stage is active and has an input coupled to receive the amplified feedback signal 22 and an output at which the LDO output voltage VLDO is provided. An operational amplifier 20 has a first input coupled to receive a feedback voltage $V_{Sense}$ 56 based on the LDO output voltage VLDO, a second input coupled to receive a reference voltage $V_{Ref}$, and an output at which the amplified feedback signal 22 is provided. A compensation capacitor 26 is selectively coupled between the operational amplifier and either the first LDO stage 14 or the second LDO stage 18. The feedback voltage $V_{Sense}$ 56 can be generated by a resistor divider 54 coupled to the LDO output voltage VLDO, as shown.

With this arrangement, the operational amplifier 20 and the compensation capacitor 26 are effectively shared by the two LDO stages 14, 18 such that the compensation path including capacitor 26 and the output signal 22 of amplifier 20 are connected to the active LDO stage 14, 18 and the inactive stage is disconnected and grounded as will be explained further. This arrangement permits the use of a smaller output compensation capacitor 58. This is because stability of the LDO converter 10 over the range of loads from zero load up to the maximum load current is based in part on the total compensation capacitance (i.e., the capacitance from the LDO output 48 to each stage 14, 18). Sharing of the internal compensation capacitor 26 by the LDO stages 14, 18 permits the use of a smaller output compensation capacitor 58 since the remainder of the compensation capacitance that is implemented in the regulator 10 is shared by the two LDO stages 14, 18 and thus, does not have to be replicated for each LDO stage. A smaller output compensation capacitor 58 is desirable for cost and space considerations.

In an example embodiment, the output compensation capacitor 58 can be less than 2 μF where previous solutions without the shared compensation capacitor 26 could require an output compensation capacitance on the order of 4 μF. The size of the internal shared compensation capacitor 26 is selected to achieve stability for all loads and is based on the current that the LDO regulator 10 needs to provide. In an example embodiment, LDO regulator 10 is employed in a DC-DC converter that can supply load currents up to 40 mA and that can operate with a first supply voltage (VIN) ranging from 3.5V to 40V (in the case of LDO stage 14) or a second supply voltage (VOUT) ranging from 3.3V to 26V (in the case of LDO stage 18). To achieve stability in this example, an internal compensation capacitance of 90 pF is required; however, integrating two 90 pF capacitors (one for each LDO stage 14, 18) would present a significant constraint on the area. By sharing the internal compensation capacitor 26 amongst the LDO stages 14, 18, area requirements are achievable.

In an example embodiment, the quiescent current of the LDO regulator 10 is on the order of 2.8 μA and this quiescent current consumption is temperature independent because of the use of a temperature independent current reference generator. Compared to some prior LDO regulators, this can represent a 10× reduction. Low quiescent current can permit the continued operation of the LDO regulator 10 when the system in which it is used is operated in a low power mode. Significantly, the ability of the LDO regulator 10 to operate during a lower power mode eliminates the need for complex and costly circuitry to monitor the VLDO voltage.

The first and second time intervals do not overlap so that only one of the LDO stages 14, 18 is active at a time. The compensation capacitor 26 is coupled to the first LDO stage 14 during the first time interval when the first LDO stage is active and is coupled to the second LDO stage 18 during the second time interval when the second LDO stage is active.

LDO regulator 10 implements a compensation strategy including shared compensation capacitor 26 in order to ensure stability. In an example embodiment, compensation capacitor 26 is coupled to the active LDO stage 14, 18 in a configuration that adds a pole and a zero to ensure stability over the entire range of operation, as will be explained.

The first and second supply voltages VIN, VOUT can be selected to suit the application in which the LDO regulator 10 is used. In some embodiments, the LDO regulator 10 forms part of a DC-DC converter (e.g., converter 400 of FIG. 4) and the first supply voltage can be an input supply voltage VIN to the converter and the second supply voltage can be the converter output voltage VOUT. For example, the first LDO stage 14 can be supplied by the converter input voltage VIN (i.e., can be active) during start up or when the converter is not able to supply the second LDO output stage 18 with sufficient supply voltage and the second LDO stage 18 can be supplied by the converter output voltage VOUT (i.e., can be active) once the converter output voltage is at a level sufficient to power the second LDO stage. Thus, the first time interval can correspond to a startup time interval and other times when the converter output is not considered to be within regulation and the second time interval can correspond to other times.

Each LDO stage 14, 18 includes a buffer amplifier 30, 34 and a pass element 32, 36, respectively. Buffer amplifier 30 has an input coupled to receive amplified feedback signal 22 and an output coupled to the control terminal of the pass element 32. Similarly, buffer amplifier 34 has an input coupled to receive amplified feedback signal 22 and an output coupled to the control terminal of pass element 36.

Pass elements 32, 36 can be MOSFET devices, such as the illustrated PMOS FETs, each having a source terminal coupled to the respective input voltage VIN, VOUT, a drain terminal coupled to a respective switch 70, 72, and a control, or gate terminal coupled to the output of the respective buffer amplifier 30, 34, as shown. However, it will be appreciated by those of ordinary skill in the art that pass elements 32, 36 could alternatively be NMOS FETs or BJTs as examples. Thus, although "pass element" and "pass FET" are used interchangeably herein, it will be appreciated that such elements may or may not be FETs.

Buffer amplifiers 30, 34 can take various forms suitable to provide a low output impedance so as to reduce the output resistance seen by the pass element 32, 36, respectively. For example, buffer amplifiers 30, 34 can take the form of source followers or super source followers. Further, buffer amplifiers 30, 34 can be implemented with bipolar transistors rather than MOSFETs.

During the first time interval when LDO stage 14 is active, the compensation capacitor 26 is coupled between an output of the buffer amplifier 30 and the operational amplifier 20 and, during the second time interval when LDO stage 18 is active, the compensation capacitor 26 is coupled between an output of the buffer amplifier 34 and operational amplifier 20. In particular, the compensation capacitor 26 can be coupled from the output of the buffer amplifier 30 to a cascode current mirror of the operational amplifier 20 in an Ahuja compensation feedback configuration. Such coupling of the compensation capacitor 26 permits the operational amplifier 20 to be supplied by the VLDO voltage (as contrasted, for example, to conventional Ahuja arrangements in which the capacitor would be coupled from the VLDO output 48 to the operational amplifier). It will be appreciated by those of ordinary skill in the art that feedback compensation schemes other than the illustrated Ahuja compensation can be used to add a pole and a zero to the control loop. For example, a nested Miller configuration (e.g., current mirror Miller, Miller with resistor, etc.) can be used.

Switch control logic 52 is configured to select which LDO stage 14, 18 is active at any particular time and generates signals LDO_1_ON, LDO_2_ON in order to implement the selection. Logic 52 can be responsive to the second supply voltage VOUT and to the LDO output voltage VLDO and can generate complementary, non-overlapping logic signals LDO_1_ON, LDO_2_ON accordingly. It will be appreciated that logic signals LDO_1_ON, LDO_2_ON can be active high or low. In an example in which the logic signals are active high (e.g., a logic high LDO_1_ON signal activates LDO stage 14), both signals can be low at the same time in order to introduce dead time; however, both signals are never high at the same time.

In an example embodiment, the first LDO stage 14 can be active (i.e., the first time interval can occur) when either the LDO output voltage VLDO is less than a predetermined level or the second supply voltage VOUT is less than a predetermined level and the second LDO stage 18 can be active (i.e., the second time interval can occur) when both the LDO output voltage VLDO is greater than the predetermined VLDO level and the second supply voltage VOUT is greater than the predetermined second supply voltage level. It will be appreciated by those of ordinary skill in the art that other conditions can be used to establish the first and second time intervals. For example, in some embodiments, the second LDO stage 18 can be active (i.e., the second time interval can occur) when (1) the LDO output voltage VLDO is greater than the predetermined VLDO level, (2) the second supply voltage VOUT is greater than the predetermined second supply voltage level, and (3) a soft start time interval has lapsed.

Control signals LDO_1_ON, LDO_2_ON can control various switches in order to effect selection of one of the LDO stages 14, 18 to be active (i.e., to be coupled to the compensation capacitor 26 and to be operational). A switch 60 coupled between compensation capacitor 26 and first LDO stage 14 can be controlled by the LDO_1_ON signal and a switch 62 coupled between compensation capacitor 26 and second LDO stage 18 can be controlled by the LDO_2_ON signal. When open, switches 60, 62 decouple the compensation capacitor 26 from the respective LDO stage 14, 18 and, when closed, switches 60, 62 couple the compensation capacitor 26 to the respective LDO stage 14, 18.

Whichever LDO stage 14, 18 is inactive (i.e., decoupled from the compensation capacitor 26 and not operational) can have its compensation connection pulled to ground with a switch 64, 66 under the control of respective control signals LDO_1_ON, LDO_2_ON. To this end, it will be appreciated by those of ordinary skill in the art that, although shown as separate switches, switches 60 and 62 can be combined into a single pole double throw switch. Similarly, switches 62 and 66 can be combined into a single pole double throw switch.

The described configuration is capable of compensating both LDO stages 14, 18 and the transition between one stage being active and then the other stage being active is smooth with very small drop in output voltage. This is because the output capacitor 58 is already charged to the VLDO voltage before a transition between stages 14, 18 is made. Further, the closed loop is fast so that any voltage drop that will occur naturally will be quickly corrected.

Switches 70, 72 are coupled between the drain terminal of pass FETs 32, 36 and the LDO output 48, respectively. Switches 70, 72 are controlled by respective control signals LDO_1_ON, LDO_2_ON and function to decouple the respective LDO stage from the output 48 when the respective stage is inactive.

In operation, during the first time interval when LDO stage 14 is active and LDO stage 18 is not active, the LDO_1_ON signal causes switch 60 to close, switch 64 to be positioned to couple switch 60 to the gate of pass FET 32, and switch 70 to close. Because of the complementary nature of the LDO_1_ON, LDO_2_ON signals, when LDO_1_ON is asserted, LDO_2_ON is not asserted causing switch 62 to be open, switch 66 to be coupled to ground, and switch 72 to be open. With this arrangement, pass FET 36 of inactive stage 18 is kept off because its gate terminal is pulled to VOUT by super source follower 34 and its source terminal is also coupled to VOUT. More particularly, as will be appreciated by those of ordinary skill in the art, super source follower 34 can include a high voltage portion and a low voltage portion coupled together by a high voltage switch as may be controlled by the LDO_1_ON, LDO_2_ON signals. The low voltage portion is coupled to the operational amplifier 20 and the compensation capacitor 26 through switch 62. When LDO stage 18 is not active, the high voltage switch of the super source follower 34 is open thereby permitting the source of pass FET 36 to be pulled to VOUT while the low voltage portion is pulled to ground through switch 66. With switch 72 open, protection is provided to the pass FET 36 since, under certain conditions its drain could be pulled up to a damaging level if it were coupled to the output 48 as the VLDO voltage increases. Switch 72 in its open position also prevents the VLDO output 48 from being charged through the body diode of pass FET 36.

During the second time interval when LDO stage 18 is active and LDO stage 14 is not active, the LDO_2_ON signal causes switch 62 to close, switch 66 to be positioned to couple switch 62 to the gate of pass FET 36, and switch 72 to close. Because of the complementary nature of the LDO_1_ON, LDO_2_ON signals, when LDO_2_ON is asserted, LDO_1_ON is not asserted causing switch 60 to be open, switch 64 to be coupled to ground, and switch 70 to be open. With this arrangement, pass FET 32 of inactive stage 14 is kept off because its gate terminal is pulled to VIN by super source follower 30 and its source terminal is also coupled to VIN. More particularly, as will be appreciated by those of ordinary skill in the art, super source follower 30 can include a high voltage portion and a low voltage portion coupled together by a high voltage switch as may be controlled by the LDO_1_ON, LDO_2_ON signals. The low voltage portion is coupled to the operational amplifier 20 and the compensation capacitor 26 through switch 60. When LDO stage 14 is not active, the high voltage switch of the super source follower 30 is open thereby permitting the source of pass FET 32 to be pulled to VIN while the low voltage portion is pulled to ground through switch 64.

It will be appreciated by those of ordinary skill in the art that various arrangements of switches are possible to activate one of the LDO stages 14, 18 and deactivate the other. Further, the number and locations of such switches can be based at least in part of the type of application for the LDO regulator 10.

The LDO regulator 10 can include a current limit feature. In particular, a first current limit circuit 40 can be configured to sense a load current through the pass element 32 of the first LDO stage 14 and couple the control terminal of the pass element 32 to the first supply voltage VIN if the sensed load current is greater than a predetermined current level. Similarly, a second current limit circuit 42 can be configured to sense a load current through the pass element 36 of the second LDO stage 18 and couple the control terminal of the pass element 36 to the second supply voltage VOUT if the sensed load current is greater than the predetermined level. It will be appreciated by those of ordinary skill in the art that although the current limit circuits 40, 42 are, in the example embodiment, substantially identical to each other and have a configuration shown and described in connection with FIG. 3, it is possible for the current limit circuits 40, 42 to have different configurations and features.

As shown and described in connection with example current limit circuit 40 in FIG. 3, according to a further aspect of the disclosure, the current limit circuit 40 can include a sense FET, a drain voltage replication circuit, and a current comparator. Suffice it to say here that the sense FET has a gate terminal coupled to the gate terminal of the pass FET, a source terminal coupled to the first supply voltage and a drain terminal and is configured to generate the sensed load current. The drain voltage replication circuit is coupled between the drain terminal of the pass FET and the drain terminal of the sense FET and configured to replicate the voltage on the drain terminal of the pass FET so that the sensed load current is indicative of the load current through the pass FET when the pass FET is in a linear region. The current comparator can be configured to compare the sensed load current to the predetermined current level.

Figure 2:
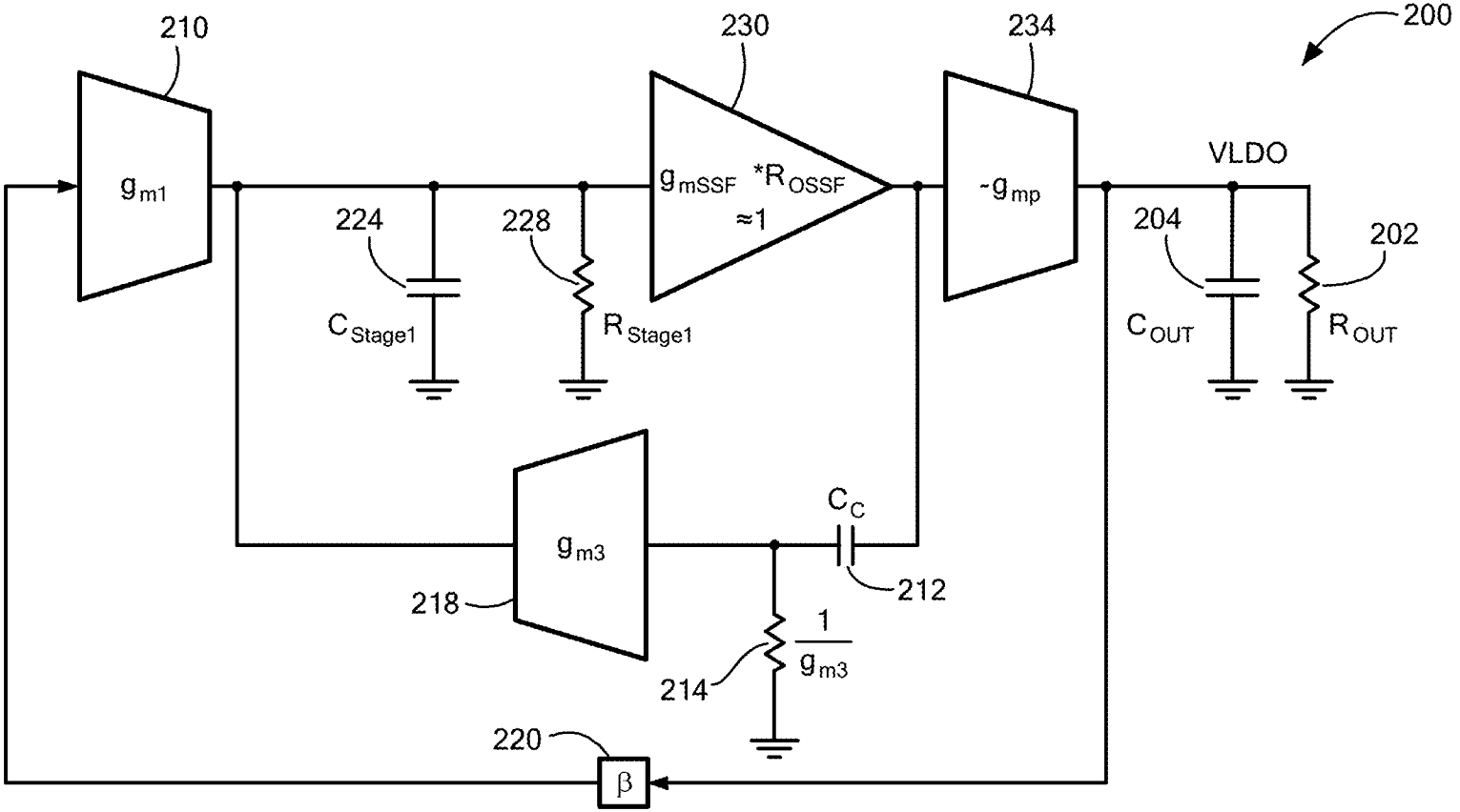
FIG. 2 is a small signal diagram of the LDO voltage regulator of FIG. 1.

Referring also to FIG. 2, a small signal block diagram 200 of the LDO regulator 10 is shown, with only the active one of the LDO stages 14, 18 (e.g., stage 14). Diagram 200 includes an output at which the LDO voltage VLDO is provided (as may be the same as or similar to output 48 of FIG. 1) and an output compensation capacitor 204 and load 202 (as may be the same as or similar to elements 58, 50 of FIG. 1).

Compensation capacitor 212 can be the same as or similar to compensation capacitor 26 of FIG. 1. Impedance 214 and transconductance 218, along with the compensation capacitor 212, can represent the feedback compensation. Element 210 can represent the transconductance of operational amplifier 20 (FIG. 1), capacitor 224 can represent the input capacitance of the super source follower 30 (FIG. 1), resistance 228 can represent the output impedance of operational amplifier 20 in parallel with the input impedance of the super source follower 30 (FIG. 1), element 230 can represent the transconductance and impedance of the super source follower 30 (FIG. 1), element 234 can represent pass element 32 (FIG. 1), and feedback element 220 can represent the feedback connection by resistor divider 54 (FIG. 1). Regarding element 228, since the input impedance of the super source follower is much larger than the output impedance of the operational amplifier 20, the overall term is dominated by the output impedance of the operational amplifier 20. More particularly, the internal compensation capacitor 212 can be coupled between the output of the super source follower 230 and a current mirror of the operational amplifier 20 (FIG. 1). Thus, transconductance element 218 and impedance element 214 can represent the current mirror of the operational amplifier.

Adaptive biasing is implemented on the output buffer stage 30 (FIG. 1) in order to achieve stable operation given the low quiescent current. Pass element 32 adds a parasitic pole that is insignificant for stability at low loads when the super source follower 30 can effectively mitigate its effect. For higher loads however, this parasitic pole is more critical, so needs to be moved to higher frequencies. The parasitic pole is set by the parasitic capacitance of the pass element 32 and the resistance of the output buffer stage 30. The resistance of the output buffer stage 30 is proportional to the current through this stage. So, the current through the buffer stage is the minimum current required to achieve stability at low loads, and then increases as the output current supplied by the LDO regulator increases.

More particularly, when the load is very small, the output resistance 202 of the LDO regulator will be large (i.e., $R_{OUT}=3.3V/I_{LOAD}$) and will make the output pole dominant. The added pole and zero will be close to one another and will compensate each other, leaving only the output pole and making the LDO regulator in this operating region a single pole system. On the other hand, when the load current is large, the output resistance 202 is small. This operating condition will move the output pole to higher frequency, and the internal pole added by the internal compensation capacitor will be the dominant pole. The added internal zero will compensate the output pole and the result is a single pole system.

It will be appreciated that although the parasitic pole of the pass element 32 is never completely removed, it reduces the phase margin of the system at both high and low loads. The super source follower 30 with its adaptive biasing ensures that through the different corners and temperatures there is enough phase margin for the LDO regulator to be stable.

Figure 3:
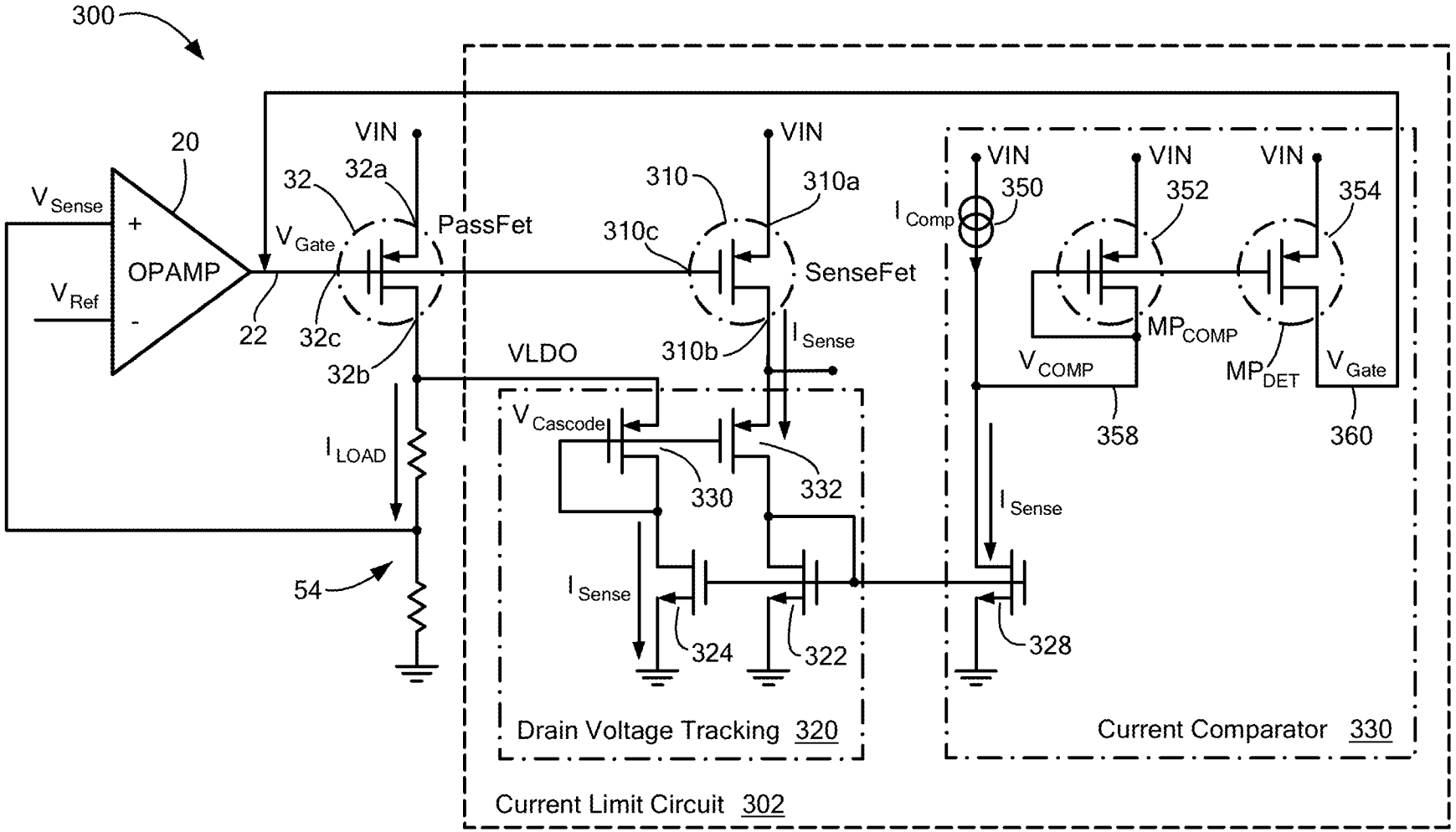
FIG. 3 is a schematic of a current limit circuit of the LDO voltage regulator of FIG. 1.

Referring also to FIG. 3, a portion 300 of the LDO regulator 10 of FIG. 1 including a current limit circuit 302 is shown. Current limit circuit 302 is configured to limit the amount of current that can be drawn from the LDO. For example, when the load current reaches 60 mA, the current limit can freeze the supplied current to that level and not permit any higher current to be supplied.

Current limit circuit 302 may be the same as or similar to one or both of current limit circuits 40, 42 of FIG. 1. For example, current limit circuit 302 can provide circuit 40 of FIG. 1 and thus, can be coupled to LDO stage 14 that receives a supply voltage VIN when active and includes pass FET 32, as shown. Pass FET 32 includes a source terminal 32*a*, a drain terminal 32*b*, and a control, or gate terminal 32*c*.

LDO regulator portion 300 includes operational amplifier 20, pass FET 32, and resistor divider 54. Current limit circuit 302 is configured to sense the load current $I_{LOAD}$ through the pass FET 32 and couple the gate 32*c* of the pass FET to the supply voltage VIN if the sensed load current is greater than a predetermined current level. As will be explained, here, the gate terminal 32*c* is coupled to the supply voltage VIN by pulling the gate voltage low in order to thereby turn on the pass FET 32.

Current limit circuit 302 includes a sense FET 310 having a gate terminal 310*c* coupled to the gate terminal 32*c* of the pass FET 32, a source terminal 310*a* coupled to the supply voltage VIN, and a drain terminal 310*b*. Sense FET 310 is configured to generate the sensed load current, or sense current $I_{sense}$. A drain voltage tracking, or replication circuit 320 is coupled between the drain terminal 32*b* of the pass FET 32 and the drain terminal 310*c* of the sense FET 310 and is configured to replicate the voltage on the drain terminal of the pass FET so that the sensed load current $I_{Sense}$ is indicative of the load current $I_{LOAD}$ through the pass FET 32 even when the pass FET is in a linear region as will be explained. The current limit circuit 302 further includes a current comparator 330 configured to compare the sensed load current $I_{Sense}$ to the predetermined current level.

Drain voltage replication circuit 320 includes a current mirror having an input leg established by a FET 322 coupled in series with the sense FET 310. A first output leg of the current mirror is coupled to the current comparator 330 and is established by FET 328. A second output leg of the current mirror is established by FET 324. The drain voltage replication circuit 320 further includes a cascode pair including FETs 330, 332. An input leg of the cascode pair includes FET 330 and is coupled to the drain terminal 32*b* of the pass FET 32 and to the second output leg of the current mirror (i.e., to FET 324). An output leg of the cascode pair includes FET 332 and is coupled to the input leg of the current mirror (i.e., to FET 322) and to the drain terminal 310*b* of the sense FET 310 at which a replicated version of the pass FET drain voltage is provided.

Drain voltage replication circuit 320 functions to replicate the pass FET drain voltage at the drain of the sense FET 310. This is accomplished by reading the current through the sense FET 310 with a current mirror and then reproducing the read current under the voltage produced by the LDO (i.e., the drain voltage of the sense FET 310). The current is read again with a current mirror and reproduced with a transistor at the drain of the sense FET 310. This configuration keeps track of the voltage at the drain of the sense FET 310, which in turn ensures that the sense FET 310 always reads the correct current through the pass FET 32 and the current limit is set to the desired value.

In operation, the current through the pass FET 32 is read by the sense FET 310 to generate the sensed load current $I_{Sense}$ as given by: $I_{Sense}=I_{LOAD}(M_{sense\ FET}/M_{pass\ FET})$. The sensed load current $I_{Sense}$ is then compared by the current comparator 330 to a reference current $I_{Comp}$ generated by a current reference 350. If the sensed load current $I_{Sense}$ is greater than the reference current $I_{Comp}$, then a $V_{COMP}$ node 358 is pulled towards ground. This turns on FETs 352 and 354. FET 354 starts to pull the gate 32*c* of the pass FET 32 to the supply voltage VIN by a connection $V_{Gate}$ 360, thereby limiting the current that the LDO can provide. This means that an overcurrent condition has been detected and the LDO cannot supply more than the current at which the overcurrent condition is detected.

Significantly, drain voltage replication circuit 320 with its positive feedback ensures that the sensed load current $I_{Sense}$ is an accurate indication of the pass FET current $I_{LOAD}$, even when the pass FET 32 is in the linear region. In some applications under certain operating conditions, the pass FET will operate in the linear region as explained below in connection with the example converter application of FIG. 4.

Current reference 350 can be trimmed to minimize or remove tolerances as may be due to process variations. With the described current limit circuit 302, temperature variation is almost completely removed, corner variations are trimmable, and the only variation might arise from the mismatch between the pass FET 32 to sense FET 310 and the mirror pairs used in the current comparator 330. The mismatch variations are addressed and minimized by sizing (increasing the length of the mirror transistors) and layout (placing the pairs close to one another and in the same direction, placing the sense FET in the middle of the pass FET). Thus, the described current limit circuit 302 provides precise current limit operation through a range of corners and temperatures.

Additionally, very low quiescent, or static current is consumed by the current limit circuit 302, such as on the order of 100 nA. The static current cannot be much if any lower than 100 nA since if it were, the current read through the sense FET 310 would be insignificant which, in turn, would make the replicated sensed current under the output of the LDO negligible and the drain voltage of the pass FET 32 would not be replicated on the drain terminal 310*c* of the sense FET 310.

It will be appreciated that the current consumption during a lower power mode of an application system is not affected by the rest of the current comparator 330, as it is only active and only consumes current when the sensed current $I_{Sense}$ is close in value to the reference current $I_{Comp}$. This happens only when high currents are being delivered by the pass FET 32, a condition in which the application system is not in low power mode.

It will be appreciated by those of ordinary skill in the art that while FIG. 3 illustrates only one current limit circuit 302 as may correspond to current limit circuit 40 of FIG. 1, the LDO voltage regulator of FIG. 1 can include both current limit circuits 40, 42. Further, current limit circuits 40, 42 can share the current reference 350 and thus, have the same overcurrent threshold or trip level. Alternatively, however, in some applications it may be desirable for current limit circuits 40, 42 to have different overcurrent trip levels. For example, if the pass element of one of the LDO stages 14, 18 is larger than the pass element of the other LDO stage in order to provide a larger load current, then the current limit circuit associated with the larger pass element may have a higher overcurrent trip level.

Figure 4:
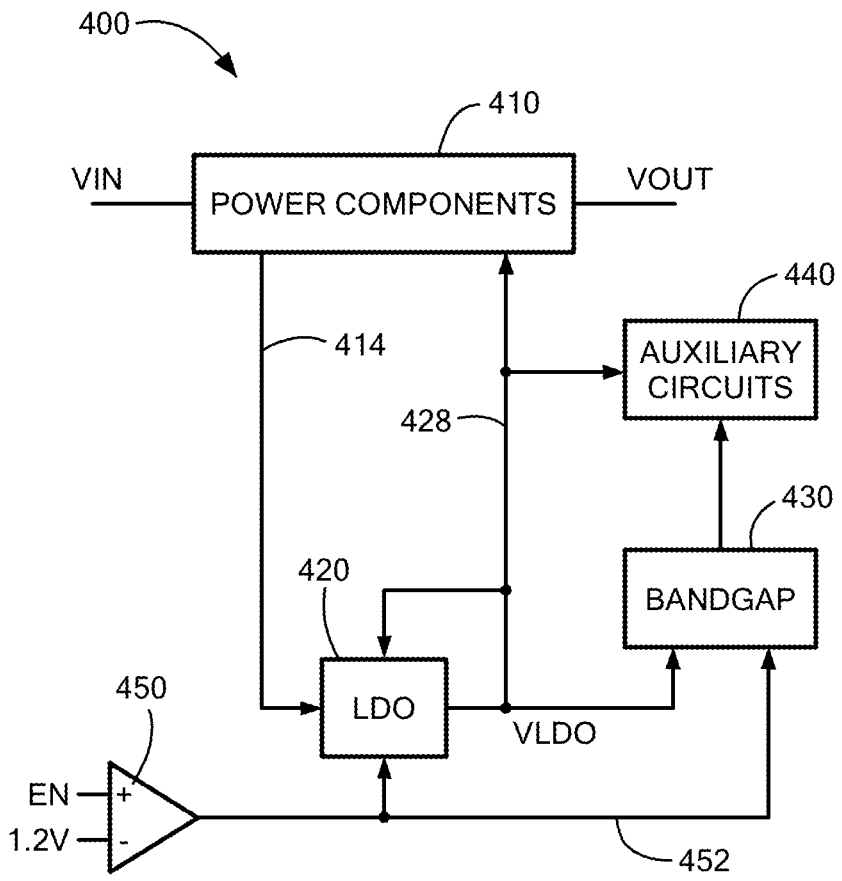
FIG. 4 is an example application system for the LDO voltage regulator of FIG. 1.

Referring also to FIG. 4, a DC-DC converter 400 can include an LDO voltage regulator 420 that is the same as or similar to LDO voltage regulator 10 of FIG. 1. Thus, LDO voltage regulator 420 can have a first LDO stage that is coupled to receive a first supply voltage in the form of input voltage VIN during a first time interval when the first LDO stage is active and can have a second LDO stage that is coupled to receive a second supply voltage in the form of output voltage VOUT during a second, non-overlapping time interval when the second LDO stage is active.

Converter 400 includes power components 410 configured to convert input voltage VIN to output voltage VOUT. In some embodiments, converter 400 (or parts of converter 400) can be provided in the form of an integrated circuit having pins, terminals, or connections. Converter 400 can be coupled to receive a supply, or input voltage VIN from a power supply (not shown) and is configured to generate an output voltage VOUT to power a load (not shown).

Converter 400 can take various forms or topologies, such as a Buck converter, a boost converter, or a Buck boost converter by way of non-limiting examples, in order to meet various application requirements. Converter 400 can incorporate various control methodologies and can include other features. Power components 410 can include an error amplifier responsive to a feedback signal based on the converter output VOUT and to a soft start signal and configured to generate a signal that is used by a controller to generate control signals for switching elements.

LDO voltage regulator 420 is coupled to receive power on a line 414 as may be a selected one of the input voltage VIN to the converter 400 or output voltage VOUT generated by the converter. For example, as explained generally above, a first stage of the LDO regulator 420 can be supplied by the converter input voltage VIN and be active during start up or when the converter is not able to supply a second stage of the LDO regulator with sufficient supply voltage and the second LDO stage can be supplied by the converter output voltage VOUT and be active once the converter output voltage is at a level sufficient to power the second LDO stage. This configuration is advantageous because it is more efficient to supply the LDO from the output voltage VOUT of the converter rather than from the input voltage VIN; however, during start up, the output voltage VOUT is too low to supply the LDO regulator 420, so the input voltage VIN powers the LDO regulator 420 during start up. Thus, the first time interval when the first LDO stage is active can correspond to a startup time interval and other times when the converter output is not considered within regulation and the second time interval when the second LDO stage is active can correspond to other times.

For example, components 410 can include a switch controlled by one or both signals LDO_1_ON, LDO_2_ON as may be generated by the switch control logic 52 of FIG. 1 whereby LDO_1_ON is asserted to cause the switch to select input voltage VIN for coupling to the LDO regulator 420 during the above-described first time interval (e.g., when either the LDO output voltage VLDO is less than a predetermined level or the second supply voltage VOUT is less than a predetermined level) and LDO_2_ON is asserted to cause the switch to select the output voltage VOUT for coupling to the LDO regulator 420 during the above-described second time interval (e.g., when (1) the LDO output voltage VLDO is greater than the predetermined VLDO level, (2) the second supply voltage VOUT is greater than the predetermined second supply voltage level, and (3) a soft start time interval has lapsed).

In an example embodiment, converter 400 can operate with a range of input voltages VIN from between approximately 3.5V up to 40V. Given such a range of possible input voltages, the first LDO stage that is coupled to receive input voltage VIN (e.g., stage 14 of FIG. 1) will operate in the linear region, particularly during startup when the input voltage VIN is close to the LDO output voltage VLDO. Thus, the ability of the current limit circuits of the LDO regulator 420 to accurately sense the load current under all conditions including when the pass element is in the linear region is particularly important. Further, in an example embodiment, the output voltage VOUT of the converter 400 can range from between approximately 3.3V to 26V. Thus, if the converter output VOUT has a nominal level of 3.3V, the second LDO stage 18 (FIG. 1) will always operate in linear region (i.e., the output voltage VOUT will be close to the LDO output voltage VLDO under all operating conditions) further highlighting the importance of the ability of the current limit circuit to accurately sense the load current even when the pass FET is in the linear region.

LDO voltage regulator 420 generates an LDO output voltage VLDO 428 that can power a bandgap circuit 430, auxiliary circuits 440 and additionally can power components of the LDO voltage regulator itself, such as a shared operational amplifier that can be the same as or similar to amplifier 20 of FIG. 1. Bandgap circuit 430 can provide one or more bandgap reference voltages for use by auxiliary circuits 440. The LDO output voltage VLDO 428 can additionally power one or more drivers and other elements of the converter power components 410.

An enable signal EN (as may be an externally generated signal) can be compared to a reference voltage such as 1.2V by a comparator 450 to generate a signal 452 for coupling to the LDO voltage regulator 420 and the bandgap circuit 430. After a predetermined time interval, the EN signal can transition to initiate operation of a soft start feature, following which switching operation of the power components 410 can commence.

It will be appreciated by those of ordinary skill in the art that the illustrated delineation of blocks and their functionality are illustrative only and that implementation of the LDO regulator and its features, such as the current limit circuits, can be varied according to design considerations. Further, while electronic circuits shown in figures herein may be shown in the form of analog blocks or digital blocks, it will be understood that the analog blocks can be replaced by digital blocks that perform the same or similar functions and the digital blocks can be replaced by analog blocks that perform the same or similar functions. Analog-to-digital or digital-to-analog conversions may not be explicitly shown in the figures but should be understood.

All references cited herein are hereby incorporated herein by reference in their entirety.

Having described preferred embodiments, it will now become apparent to one of ordinary skill in the art that other embodiments incorporating their concepts may be used. Elements of different embodiments described herein may be combined to form other embodiments not specifically set forth above. Various elements, which are described in the context of a single embodiment, may also be provided separately or in any suitable subcombination. Other embodiments not specifically described herein are also within the scope of the following claims. For example, while a three-phase motor is described, the described principles and techniques apply to an electric motor having more than or fewer than three phases.

It is felt therefore that these embodiments should not be limited to disclosed embodiments, but rather should be limited only by the spirit and scope of the appended claims.

What is claimed is:

1. A low dropout (LDO) voltage regulator, comprising:

a first LDO stage coupled to receive a first supply voltage and active during a first time interval, the first LDO stage having an input coupled to receive an amplified feedback signal and an output at which an LDO output voltage is provided;

a second LDO stage coupled to receive a second supply voltage and active during a second time interval that does not overlap with the first time interval, the second LDO stage having an input coupled to receive the amplified feedback signal and an output at which the LDO output voltage is provided;

an operational amplifier having a first input coupled to receive a feedback voltage based on the LDO output voltage, a second input coupled to receive a reference voltage and an output at which the amplified feedback signal is provided; and a compensation capacitor selectively coupled between the operational amplifier and either the first LDO stage or the second LDO stage.

2. The LDO voltage regulator of claim 1 wherein the compensation capacitor is coupled to the first LDO stage during the first time interval and wherein the compensation capacitor is coupled to the second LDO stage during the second time interval.

3. The LDO voltage regulator of claim 1 wherein each of the first LDO stage and the second LDO stage comprises a buffer amplifier and a pass element, wherein the buffer amplifier has an input coupled to receive the amplified feedback signal and an output coupled to a control terminal of the pass element.

4. The LDO voltage regulator of claim 3 wherein, during the first time interval, the compensation capacitor is coupled between the output of the buffer amplifier of the first LDO stage and the operational amplifier and wherein, during the second time interval, the compensation capacitor is coupled between an output of the buffer amplifier of the second LDO stage and operational amplifier.

5. The LDO voltage regulator of claim 3 further comprising a first current limit circuit configured to sense a load current through the pass element of the first LDO stage and couple the control terminal of the pass element of the first LDO stage to the first supply voltage if the sensed load current is greater than a predetermined current level.

6. The LDO voltage regulator of claim 5 wherein the pass element of the first LDO stage is a pass FET having a drain terminal and a source terminal and wherein the control terminal of the pass element is a gate terminal, wherein the first current limit circuit comprises:

a sense FET having a gate terminal coupled to the gate terminal of the pass FET, a source terminal coupled to the first supply voltage and a drain terminal and configured to generate the sensed load current;

a drain voltage replication circuit coupled between the drain terminal of the pass FET and the drain terminal of the sense FET and configured to replicate a voltage on the drain terminal of the pass FET so that the sensed load current is indicative of the load current through the pass FET when the pass FET is in a linear region; and a current comparator configured to compare the sensed load current to the predetermined current level.

7. The LDO voltage regulator of claim 5 further comprising a second current limit circuit configured to sense a load current through the pass element of the second LDO stage and couple the control terminal of the pass element of the second LDO stage to the second supply voltage if the sensed load current is greater than the predetermined level.

8. The LDO voltage regulator of claim 7 wherein the pass element of the second LDO stage is a pass FET having a drain terminal and a source terminal and wherein the control terminal of the pass element is a gate terminal, wherein the second current limit circuit comprises:

a sense FET having a gate terminal coupled to the gate terminal of the pass FET, a source terminal coupled to the second supply voltage and a drain terminal and configured to generate the sensed load current;

a drain voltage replication circuit coupled between the drain terminal of the pass FET and the drain terminal of the sense FET and configured to replicate a voltage on the drain terminal of the pass FET so that the sensed load current is indicative of the load current through the pass FET when the pass FET is in a linear region; and a current comparator configured to compare the sensed load current to the predetermined current level.

9. The LDO voltage regulator of claim 1 wherein the first time interval occurs when either the LDO output voltage is less than a predetermined LDO output voltage level or the second supply voltage is less than a predetermined second supply voltage level and wherein the second time interval occurs when both the LDO output voltage is greater than the predetermined LDO output voltage level and the second supply voltage is greater than the predetermined second supply voltage level.

10. A converter, comprising:

a power stage responsive to a supply input voltage and configured to generate a regulated output voltage, wherein the power stage is coupled to receive an LDO output voltage; and a low dropout (LDO) voltage regulator responsive to the supply input voltage during a first time interval and responsive to the regulated output voltage during a second time interval that does not overlap with the first time interval, wherein the LDO voltage regulator is configured to generate the LDO output voltage, the LDO voltage regulator comprising:

a first LDO stage coupled to receive the supply input voltage and active during the first time interval, the first LDO stage having an input coupled to receive an amplified feedback signal and an output at which the LDO output voltage is provided;

a second LDO stage coupled to receive the regulated output voltage and active during the second time interval, the second LDO stage having an input coupled to receive the amplified feedback signal and an output at which the LDO output voltage is provided;

an operational amplifier having a first input coupled to receive a feedback voltage based on the LDO output voltage, a second input coupled to receive a reference voltage and an output at which the amplified feedback signal is provided; and a compensation capacitor selectively coupled between the operational amplifier and either the first LDO stage or the second LDO stage.

11. The converter of claim 10 further comprising one or more auxiliary circuits coupled to receive the LDO output voltage.

12. The converter of claim 10 wherein the compensation capacitor is coupled to the first LDO stage during the first time interval and wherein the compensation capacitor is coupled to the second LDO stage during the second time interval.

13. The converter of claim 10 wherein the first LDO stage comprises a first buffer amplifier and a first pass FET, wherein the first buffer amplifier has an input coupled to receive the amplified feedback signal and an output coupled to a gate terminal of the first pass FET and wherein the second LDO stage comprises a second buffer amplifier and a second pass FET, wherein the second buffer amplifier has an input coupled to receive the amplified feedback signal and an output coupled to a gate terminal of the second pass FET.

14. The converter of claim 13 wherein, during the first time interval, the compensation capacitor is coupled between the output of the buffer amplifier of the first LDO stage and the operational amplifier and wherein, during the second time interval, the compensation capacitor is coupled between the output of the buffer amplifier of the second LDO stage and operational amplifier.

15. The converter of claim 13 further comprising one or both of: (1) a first current limit circuit configured to sense a load current through the first pass FET and couple the gate terminal of the first pass FET to the supply input voltage if the sense current is greater than a predetermined current level; and (2) a second current limit circuit configured to sense the load current through the second pass FET and couple the gate terminal of the second pass FET to the regulated output voltage if the sense current is greater than the predetermined current level.

16. The converter of claim 15 wherein the first current limit circuit comprises:

a first sense FET having a gate terminal coupled to the gate terminal of the first pass FET, a source terminal coupled to the supply input voltage and a drain terminal and configured to generate a sense current;

a first drain voltage replication circuit coupled between the drain terminal of the first pass FET and the drain terminal of the first sense FET and configured to replicate a voltage on the drain terminal of the first pass FET so that the sense current is indicative of the load current through the first pass FET when the first pass FET is in a linear region; and a current comparator configured to compare the sense current to the predetermined current level and wherein the second current limit circuit comprises:

a second sense FET having a gate terminal coupled to the gate terminal of the second pass FET, a source terminal coupled to the regulated output voltage and a drain terminal and configured to generate a sense current;

a second drain voltage replication circuit coupled between the drain terminal of the second pass FET and the drain terminal of the second sense FET and configured to replicate a voltage on the drain terminal of the second pass FET so that the sense current is indicative of the load current through the second pass FET when the second pass FET is in a linear region; and a current comparator configured to compare the sense current to the predetermined current level.

17. A current limit circuit for a low dropout (LDO) voltage regulator comprising a pass FET having a source terminal coupled to an input voltage, a gate terminal, and a drain terminal at which a load current is provided, the current limit circuit comprising:

a sense FET having a gate terminal coupled to the gate terminal of the pass FET, a source terminal coupled to a supply voltage and a drain terminal and configured to generate a sense current;

a drain voltage replication circuit coupled between the drain terminal of the pass FET and the drain terminal of the sense FET and configured to replicate a voltage on the drain terminal of the pass FET so that the sense current is indicative of the load current when the pass FET is in a linear region; and a current comparator configured to compare the sense current to a predetermined current level, wherein the current comparator is configured to couple the gate terminal of the pass FET to the input voltage if the sense current is greater than the predetermined current level.

18. The current limit circuit of claim 17 wherein the drain voltage replication circuit comprises:

a current mirror having an input leg in series with the sense FET and a first output leg coupled to the current comparator and a second output leg; and a cascode pair having an input leg coupled to the drain terminal of the pass FET and to the second output leg of the current mirror and an output leg coupled to the input leg of the current mirror and to the drain terminal of the sense FET at which a replicated version of the pass FET drain voltage is provided.

19. A method for current limiting in a low dropout (LDO) voltage regulator comprising a pass FET having a source terminal coupled to an input voltage, a gate terminal, and a drain terminal at which a load current is provided, comprising:

sensing the load current with a sense FET having gate terminal coupled to the gate terminal of the pass FET, a source terminal coupled to the input voltage, and a drain terminal at which a sense current is provided;

replicating a voltage at the drain terminal of the pass FET with a voltage replication circuit to generate a replicated voltage at the drain terminal of the sense FET;

comparing the sense current to a predetermined current level; and coupling the gate terminal of the pass FET to the input voltage if the sense current exceeds the predetermined current level.

20. The method of claim 19 wherein replicating a voltage at the drain terminal of the pass FET with the voltage replication circuit comprises:

mirroring the sense current with a current mirror;

coupling the current mirror to the drain terminal of the pass FET with a first element of a cascode pair; and coupling the current mirror the drain terminal of the sense FET with a second element of the cascode pair.

21. A current limit circuit for a low dropout (LDO) voltage regulator comprising a pass FET having a source terminal coupled to an input voltage, a gate terminal, and a drain terminal at which a load current is provided, the current limit circuit comprising:

a sense FET having a gate terminal coupled to the gate terminal of the pass FET, a source terminal coupled to a supply voltage and a drain terminal and configured to generate a sense current;

a drain voltage replication circuit coupled between the drain terminal of the pass FET and the drain terminal of the sense FET and configured to replicate a voltage on the drain terminal of the pass FET so that the sense current is indicative of the load current when the pass FET is in a linear region; and a current comparator configured to compare the sense current to a predetermined current level;

wherein the drain voltage replication circuit comprises:

a current mirror having an input leg in series with the sense FET and a first output leg coupled to the current comparator and a second output leg; and a cascode pair having an input leg coupled to the drain terminal of the pass FET and to the second output leg of the current mirror and an output leg coupled to the input leg of the current mirror and to the drain terminal of the sense FET at which a replicated version of the pass FET drain voltage is provided.

* * * * *